US006764414B2

(12) United States Patent
Kumamoto

(10) Patent No.: US 6,764,414 B2
(45) Date of Patent: Jul. 20, 2004

(54) GOLF CLUB SHAFT

(75) Inventor: Tomio Kumamoto, Hyogo (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 10/224,599

(22) Filed: Aug. 21, 2002

(65) Prior Publication Data

US 2003/0148820 A1 Aug. 7, 2003

(30) Foreign Application Priority Data

Aug. 31, 2001 (JP) ..... 2001-263279

(51) Int. Cl.[7] ..... A63B 53/14
(52) U.S. Cl. ..... 473/297; 473/318
(58) Field of Search ..... 473/316–322, 473/520, 521, 523, 297

(56) References Cited

U.S. PATENT DOCUMENTS 2,023,131 A * 12/1935 Gibson ..... 473/318
5,156,396 A * 10/1992 Akatsuka et al. ..... 473/319
6,117,028 A * 9/2000 You ..... 473/520

FOREIGN PATENT DOCUMENTS

JP 5-123428 5/1993
JP 9-216958 8/1997
JP 10-36638 2/1998
JP 10-71222 3/1998

OTHER PUBLICATIONS

WO00/36022, Jun. 22, 2000, Energy Converting Compound, Hori.*

* cited by examiner

*Primary Examiner*—Stephen Blau
(74) *Attorney, Agent, or Firm*—Birch, Stewart, Kolasch & Birch, LLP

(57) ABSTRACT

In a golf club shaft hollow pipe-shaped and composed of a laminate of prepregs, a vibration absorption member (10) made of an elastic material whose tan δ at 10° C. is not less than 0.7 is installed at least one portion inside the hollow pipe-shaped golf club shaft. The vibration absorption member (10) has a body having a hollow portion, a central part connected to the body through a plurality of connection parts and disposed inside the hollow portion, a plurality of projected parts formed on a peripheral surface of the body and contacting an inner peripheral surface of the pipe-shaped golf club shaft. It is preferable that the weight of the vibration absorption member (10) is not less than 1 g nor more than 10 g, that the number of the connection parts is not less than two nor more than 10, and that the weight of the central part is not less than 10 wt % nor more than 60 wt % of a whole weight of the vibration absorption member.

10 Claims, 9 Drawing Sheets

GOLF CLUB SHAFT

BACKGROUND OF THE INVENTION

1. Field of the Invention

The present invention relates to a golf club shaft and more particularly to a lightweight golf club shaft, made of a fiber reinforced resin, which has an improved vibration-damping performance and gives a good feeling to a player when the player hits a golf ball with a golf club composed of the golf club shaft.

2. Description of the Related Art

In recent years, a golf club shaft composed of a reinforcing fiber such as a carbon fiber having a high specific strength and a high specific rigidity is manufactured and commercially available. As the specific strength and the specific rigidity of the carbon fiber become higher, the lightweight golf club shaft can be manufactured.

As the golf club shaft becomes more lightweight, the head speed of a golf club becomes increasingly higher when it is swung. Thus the player can hit a golf ball a longer distance with the golf club. On the other hand, as the golf club shaft becomes more lightweight, vibrations and impacts the player feels unpleasant are generated increasingly when the player hits the golf ball with the golf club. As the golf club shaft becomes more lightweight, the frequency of the vibration thereof becomes higher than the conventional golf club shaft. Therefore in recent years, players are increasingly damaged at their elbows and shoulders by vibrations and impacts generated when they hit the golf ball with golf clubs composed of the lightweight golf club shafts.

To suppress the vibrations generated when the player hits the golf ball, many proposals are made. For example, in Japanese Patent Application Laid-Open Nos. 9-216958 and 10-36638, resinous particles of an ethylene copolymer and rubber particles are mixed with the resin of the fiber reinforced resin layer to form the prepreg composed of the fiber reinforced resin superior in vibration suppression performance and resistance to impacts.

In the golf club shaft having the three-layer construction disclosed in Japanese Patent Application Laid-Open No. 5-123428, to obtain vibration absorption performance and a soft feeling, the vibration suppression material layer is inserted into the fiber reinforced resin layer. In the golf club shaft disclosed in Japanese Patent Application Laid-Open No. 10-71222, the vibration absorption member having a weight and the elastic material (foam) covering the weight is mounted on the grip part of the golf club shaft.

In the prepreg disclosed in Japanese Patent Application Laid-Open Nos. 9-216958 and 10-36638, the prepreg itself has vibration suppression performance. However, in the case where the prepreg is used to compose the golf club shaft, the prepreg is incapable of achieving dramatic vibration-damping performance to such an extent that the player can feel and further allowing the player to hit the golf ball a long distance with a golf club composed of the golf club shaft.

In the golf club shaft disclosed in Japanese Patent Application Laid-Open No. 5-123428, it is difficult to design the golf club shaft in such a way as to flex it. Since the degree of freedom in designing the golf club is low, it is difficult make it lightweight and increase the flight distance of the golf ball while allowing the golf club shaft to have vibration-damping performance. Further it is difficult to mold the material for the golf club shaft. Thus the golf club shaft has a problem that there is a large lot-to-lot variation in its vibration suppression function. In the golf club shaft disclosed in Japanese Patent Application Laid-Open No. 10-71222, since the metal having a high specific gravity is used as the weight, the golf club shaft is heavy and thus a player has difficulty in swinging it. In addition, it is complicated to make a design regarding the weight of the golf club shaft and form the vibration absorption member. The member in direct contact with the golf club shaft is fixed with parts harder than the elastic material. The construction of the golf club shaft has a limitation in making it lightweight and improving its vibration absorption performance.

SUMMARY OF THE INVENTION

The present invention has been made in view of the above-described problems. Therefore it is an object of the present invention to provide a golf club shaft which is more lightweight and hits a golf ball a longer distance than a conventional golf club shaft and relieves vibrations and impacts to be transmitted to a player to allow the player to feel it softer than the conventional golf club shaft.

To achieve the object, according to the present invention, there is provided a hollow pipe-shaped golf club shaft and composed of a laminate of prepregs. A vibration absorption member made of an elastic material whose tan δ at 10° C. is not less than 0.7 is installed at least one portion inside the hollow pipe-shaped golf club shaft.

The vibration absorption member made of the tan δ (loss tangent)-specified elastic material having high vibration-damping performance is installed inside the pipe-shaped golf club shaft. Thus although the golf club shaft is lightweight, a golf club composed of the golf club shaft is capable of hitting a golf ball a long distance, reducing vibrations and impacts generated when the golf ball is hit with the golf club, and giving a good feeling to a player. Since the vibration absorption member is inserted into a required position inside the hollow pipe of the golf club shaft and merely fixed thereto, it is easy to improve the vibration-damping performance of the golf club shaft.

An elastic material composing the vibration absorption member installed at least one portion inside the hollow pipe of the golf club shaft has the loss tangent (tan δ) not less than 0.7 at 10° C. The larger the loss tangent (tan δ) is, the larger the energy conversion of the vibration absorption member is. Therefore it is possible to suppress vibrations and impacts generated when the player hits the golf ball with the golf club. Thus it is possible to give an unpleasant feeling to a reduced extent when the player hits the golf ball with the golf club.

If the loss tangent (tan δ) is less than 0.7, the vibration absorption member is incapable of displaying vibration/impact suppression effect sufficiently. From this point of view, the tan δ is favorably not less than 1.0 and more favorably not less than 1.5. The upper limit of the tan δ is not specified in the present invention, but for the reason of availability of a material, which can be used for the golf club shaft, the tan δ is set to less than 5.0 and favorably to less than 4.0, and more favorably to less than 2.0.

It is preferable that the vibration absorption member has a body having a hollow portion, a central part connected to the body through a plurality of connection parts and disposed inside the hollow portion, a plurality of projected parts formed on a peripheral surface of the body and contacting an inner peripheral surface of the pipe-shaped golf club shaft.

It is preferable that the weight of the vibration absorption member is not less than 1 g nor more than 10 g; that the number of the connection parts is not less than two nor more than 10; and that the weight of the central part is not less than 10 wt % nor more than 60 wt % of a whole weight of the vibration absorption member. Owing to this construction of the vibration absorption member, its central part is capable of resonating with vibrations of the golf club shaft. Thus the vibration absorption member is capable of enhancing the vibration-damping effect to a higher extent.

The weight of the vibration absorption member is set to not less than 1 g nor more than 10 g and favorably to not less than 3 g nor more than 8 g.

If the weight of the vibration absorption member is less than 1 g, the vibration absorption member is incapable of displaying the vibration/impact damping effect sufficiently. On the other hand, if the weight of the vibration absorption member is more than 10 g, the entire golf club becomes heavy. Thus there is no degree of freedom in designing the weight of the fiber reinforced resin and the golf club has an unfavorable balance.

The number of the connection parts is set to not less than two nor more than 10, and favorably to not less than two nor more than eight, and more favorably to not less than two nor more than four. The optimum number of the connection parts is two.

If the number of the connection parts is one, the central part of the vibration absorption member is unfixable. Thus when the golf club shaft vibrates, the central part strikes against the inner wall of the vibration absorption member. Consequently the vibration absorption member is incapable of performing its vibration-absorbing function sufficiently. If the number of the connection parts is not less than 10, the central part is fixed so excessively that the vibration absorption member is incapable of resonating with vibrations of the golf club shaft and performing its vibration-absorbing function. It is preferable to dispose the connection parts at uniform intervals in the circumferential direction of the golf club shaft.

The thickness of the connection part is set preferably to not less than 0.1 mm nor more than 0.6 mm. If the thickness of the connection part is less than 0.1 mm, the connection part has a low strength. On the other hand, if the thickness of the connection part is more than 0.6 mm, the golf club shaft may have a low vibration-damping performance.

The weight of the central part is set to not less than 10 wt % nor more than 60 wt % of the whole weight of the vibration absorption member, favorably to not less than 12 wt % nor more than 50 wt %, and more favorably to not less than 15 wt % nor more than 30 wt %.

If the weight of the central part is set to less than 10 wt %, the vibration absorption member is incapable of resonating with vibrations of the golf club shaft sufficiently and is thus incapable of absorbing vibrations and impacts of the golf club shaft sufficiently. On the other hands if the weight of the central part is more than 60 wt % of the whole weight of the vibration absorption member, the parts other than the central part are required to be small in the weight thereof and will have a low strength respectively.

It is preferable to dispose the central part at approximately the center of the vibration absorption member. The central part may have various configurations. For example, the central part may be columnar, square pillar-shaped, spherical, and polygonal. A plurality of the central parts may be formed.

The vibration absorption member is disposed inside the golf club shaft by the direct contact between peripheral surface of the projected part of the vibration absorption member and the inner peripheral surface of the hollow pipe of the golf club shaft. The number of the projected parts is set to not less than two nor more than 10 and favorably to not less than two nor more than six. The most favorable number of the projected parts is four. If the number of the projected parts is one, it is difficult to fix the vibration absorption member to the interior of the golf club shaft. On the other hand, if the number of the projected parts is more than 10, it is difficult to fix the vibration absorption member to the interior of the golf club shaft. It is preferable to dispose the projected parts at regular intervals in the circumferential direction of the golf club shaft and parallel to the axial direction thereof. The projected part may be disposed intermittently in the axial direction thereof.

It is preferable that the length of the projected part and that of the vibration absorption member are equal to each other in the axial direction of the golf club shaft. When the length of the projected part is not less than ⅓ of the length of the vibration absorption member, the vibration absorption member can be sufficiently fixed to the hollow portion of the golf club shaft. To fix the vibration absorption member to the hollow portion of the golf club shaft reliably and easily, it is preferable that the width of the projected part is set to not less than 1 mm nor more than 3 mm. Further by adjusting the height of the projected part, the vibration absorption member can be shaped in conformity to the tapered inner side of the golf club shaft and fixed more easily to the hollow portion. Thereby the vibration absorption member can be fixed to the predetermined position of the hollow portion of the golf club shaft.

It is preferable to shape the vibration absorption member in such a way that the balance of the center of gravity of the golf club shaft does not deteriorate in vertical section of the axis of the golf club shaft. A plurality of vibration absorption members may be provided for one golf club shaft. It is preferable that the body of the vibration absorption member is cylindrical, but may have various configurations such as a square cylinder having the central part. Although the vibration absorption member can be formed by molding a material by known conventional methods, injection molding and press molding are preferable in consideration of moldability.

An adhesive agent, a double-coated tape, and the like can be used to fix the vibration absorption member to the golf club shaft. It is preferable to fix the vibration absorption member to the golf club shaft by using the adhesive agent, the double-coated tape or the like in combination with the tapered surface of the projected part. As a method of fixing the vibration absorption member to the golf club shaft, it is particularly preferable to taper the projected part and use the adhesive agent. Even though the adhesiveness of the adhesive agent deteriorates and the vibration absorption member separates from the golf club shaft, the tapered portion of the projected part prevents the vibration absorption member made of the elastic material from moving toward the head in the hollow portion of the golf club shaft. An adhesive agent which is hardened by heating it is preferable. It is preferable to insert the vibration absorption member into the golf club shaft and then harden the adhesive agent by heating it in bonding the vibration absorption member to the golf club shaft.

The weight of the golf club shaft is set to not less than 35 g nor more than 70 g, favorably to not less than 35 g nor more than 60 g, and more favorably to not less than 35 g nor more than 55 g, before a paint material is applied to the golf club shaft and parts are mounted thereon. The more lightweight the golf club shaft is, the higher the vibration/impact absorbing effect is.

If the weight of the golf club shaft is less than 35 g, the golf club shaft is too lightweight. Consequently it is difficult for a player to control the directionality of the golf club shaft, and the golf club shaft has a low strength. On the other hand, if the weight of the golf club shaft is more than 70 g, the player cannot increase the head speed and thus cannot increase the flight distance of a golf ball.

It is preferable that a prepreg reinforced by carbon fibers, as a reinforcing fiber thereof, whose tensile modulus of elasticity is not less than 30 tonf/mm$^2$ nor more than 80 tonf/mm$^2$ is used for the golf club shaft favorably at not less than 50 wt % and more favorably at not less than 60 wt % of the entire weight of the golf club shaft, before a paint material is applied thereto. The upper limit of the weight percentage of the prepreg may be 100 wt % but is preferably less than 95 wt % in consideration of the strength of the golf club shaft.

Since the highly elastic prepreg reinforced by the carbon fibers, as the reinforcing fiber thereof, whose tensile modulus of elasticity is not less than 30 tonf/mm$^2$ nor more than 80 tonf/mm$^2$ is used for the golf club shaft, it is possible to increase the strength of the golf club shaft and make it lightweight Although the highly elastic material having a small amount of elongation in its fiber is used for the golf club shaft, unpleasant vibrations and impacts can be effectively decreased since the vibration absorption member is mounted in the interior of the golf club shaft. By adjusting the configuration of the vibration absorption member, the disposition of the weight thereof, and the layering amount of the highly elastic materials, the advantage of both can be obtained in a well-balanced state to thereby increase the vibration-damping performance to a higher extent.

It is preferable to dispose the vibration absorption member over the whole length of the golf club shaft in consideration of its vibration-damping performance. However, in consideration of the weight of the golf club shaft, the vibration absorption member is mounted favorably on a part of the whole length of the golf club shaft. The vibration absorption member is mounted at least one portion of a range favorably 40% and more favorably 30% of the whole length of the golf club shaft from one end thereof at the grip (butt) side thereof toward the other end thereof. By disposing the vibration absorption member in the neighborhood of the grip (player's hand side), to a higher extent, the vibration absorption member is capable of suppressing vibrations to be transmitted to the player when the player hits the golf ball with the golf club.

The flexural rigidity (EI) of the golf club shaft in a range 30% of the whole length of the golf club shaft from the end thereof at the grip (butt) side toward the other end thereof is set to not less than 4 kg·m$^2$ nor more than 10 kg·m$^2$, favorably to not less than 5 kg·m$^2$ nor more than 10 kg·m$^2$, and more favorably to not less than 6 kg·m$^2$ nor more than 10 kg·m$^2$.

If the flexural rigidity (EI) of the golf club shaft in the above-described range is less than 4 kg·m$^2$, the player feels soft and has a bad feeling when the player hits the golf ball with the golf club. On the other hand, if the flexural rigidity (EI) of the golf club shaft in the above-described range is more than 10 kg·m$^2$, the player feels hard and has a bad feeling when the player hits the golf ball with the golf club. Further the flexural rigidity (EI) in the vicinity of the player's hand is so large that vibrations and impacts are readily transmitted to the player's hand. In this case, the effect of the present invention is reduced.

To set the flexural rigidity to the above-described range, it is preferable to layer prepregs each reinforced by the carbon fibers, as the reinforcing fiber thereof, whose tensile modulus of elasticity is more than 55 tonf/mm$^2$ in the range not less than 30% of the whole length of the golf club shaft from the end thereof at the grip (butt) side toward the other end thereof. By using the material having a high elastic modulus of elasticity for the golf club shaft, it is possible to make the golf club shaft lightweight and increase its rigidity value in the above-described range.

As the elastic material, the following materials satisfying the tan δ can be used: a dipole conversion material, a mixture of a thermoplastic elastomer and polypropylene, various resinous materials, rubber, and a mixture of these materials. It is preferable to form the vibration absorption member of a single material (uniform material) by molding it, in consideration of the strength and moldability thereof. The single material means a uniform material. A mixture of a plurality of materials can be used for the vibration absorption member, provided that the vibration absorption member is formed by molding the mixed materials uniformly.

The dipole conversion material has the following characteristics: when vibrations are applied to the dipole conversion material, positive and negative dipoles separate from each other and then attract each other. At that time, the dipoles contact a polymeric chain serving as the base of the dipole conversion material. As a result, a large amount of a vibration energy generated as a friction heat is converted into a thermal energy.

More specifically, the positive and negative dipoles are present in the dipole conversion material in a stable state with charges attracting each other. When vibrations are applied to the dipole conversion material, the positive and negative dipoles separate from each other and a restoring action that they attract each other occurs. At that time, the dipoles contact the polymeric chain serving as the base of the dipole conversion material. As a result, a large amount of the vibration energy generated as the friction heat is converted into the thermal energy. Owing to this action, the dipole conversion material absorbs the vibration energy.

It is preferable to form the dipole conversion material by adding an active component for increasing the moment of the dipoles to a polar high-molecular weight substance.

As the polar high-molecular weight substance, one of the following substances or a combination thereof can be preferably used: chlorinated polyethylene, EVA, acrylonitrile butadiene rubber (NBR), polyvinyl chloride, acrylic rubber (ACR), styrene butadiene rubber (SBR), chloroprene rubber (CR). In consideration of the adhesiveness of the polar high-molecular weight substance to the prepreg, chlorinated polyethylene and EVA are particularly favorable.

As the active component, it is possible to use one of the following substances or a combination thereof: a compound containing mercaptobenzothiazole radical, a compound containing benzothiazole radical, and a compound containing diphenyl acrylate radical.

As examples of a mixture of the thermoplastic elastomer and the polypropylene, it is possible to use Elastage produced by Toso Kabushiki Kaisha and the polypropylene, Labaron produced by Mitsubishi Kagaku Kabushiki Kaisha and the polypropylene, and Hybla produced by Kuraray Kabushiki Kaisha and the polypropylene. It is preferable to mix the thermoplastic elastomer and the polypropylene with each other at a mixing ratio of 70:30–85:15.

As reinforcing fibers, for the prepreg, other than the carbon fiber whose tensile modulus of elasticity is not less than 30 tonf/mm$^2$ nor more than 80 tonf/mm$^2$, it is possible to use glass fiber, aramid fiber, boron fiber, aromatic polyamide fiber, aromatic polyester fiber, and ultra-high-molecular-weight polyethylene fiber.

As the resin which is used as the fiber reinforced resin, thermosetting resin and thermoplastic resin and the like can be used. In consideration of strength and rigidity, the thermosetting resin is preferable. Epoxy resin is particularly favorable.

As the thermosetting resin, the following resins can be used: epoxy resin, unsaturated polyester resin, phenol resin, melamine resin, urea resin, diallyl phthalate resin, polyurethane resin, polyimide resin, and silicon resin.

The thermoplastic resin includes polyamide resin, saturated polyester resin, polycarbonate resin, ABS resin, polyvinyl chloride resin, polyacetal resin, polystyrene resin, polyethylene resin, polyvinyl acetate, AS resin, methacrylate resin, polypropylene resin, and fluorine resin.

The golf club shaft of the present invention is applicable to all kinds of golf clubs. For example, a wooden head can be mounted on the golf club shaft of the present invention to compose a driver or an iron head can be mounted thereon. The golf club shaft of the present invention may be used as a patter.

DETAILED DESCRIPTION OF THE PREFERRED EMBODIMENTS

The embodiments of the present invention will be described below with reference to drawings.

Figure 1A:
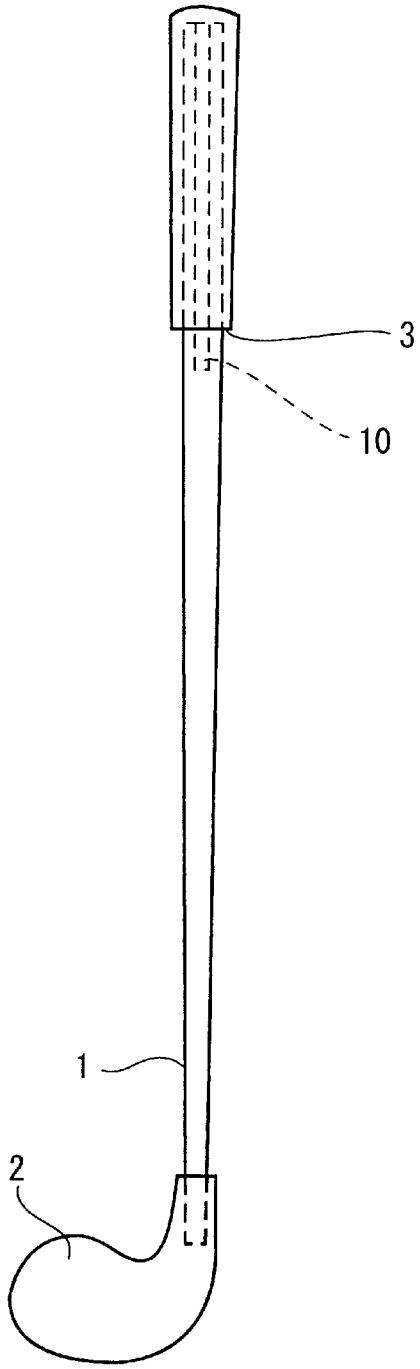
FIG. 1A is a schematic view showing a golf club shaft according to the present invention.
Figure 1B:
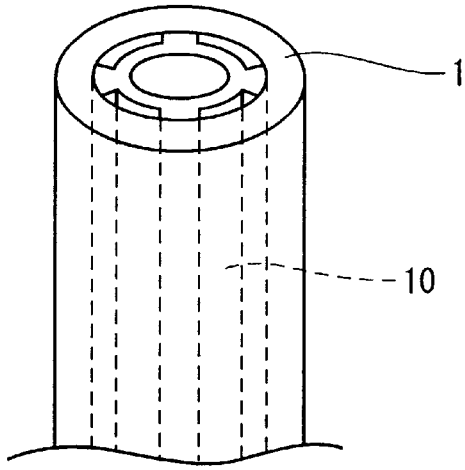
FIG. 1B shows a disposed situation of a vibration absorption member inside a hollow pipe of the golf club shaft.
Figure 2A:
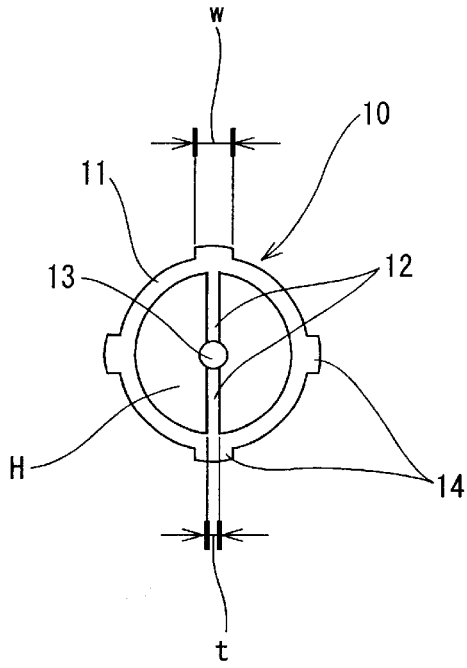
FIG. 2A is a front view showing a vibration absorption member.
Figure 2B:
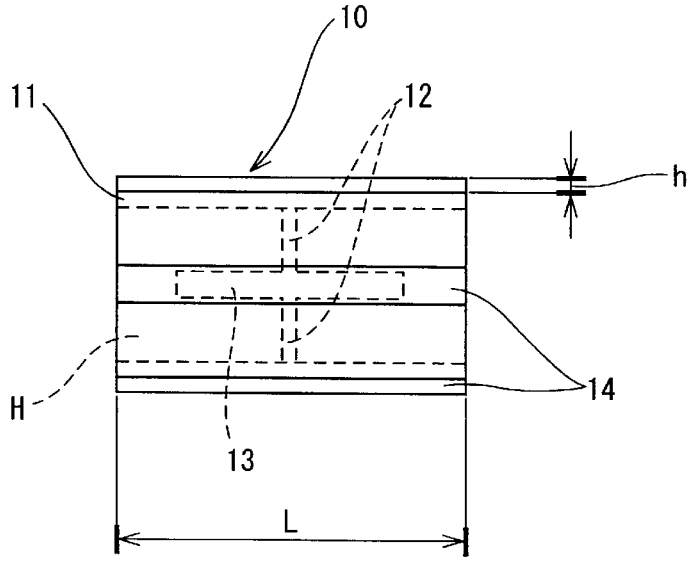
FIG. 2B is a side view showing the vibration absorption member.
Figure 3A:
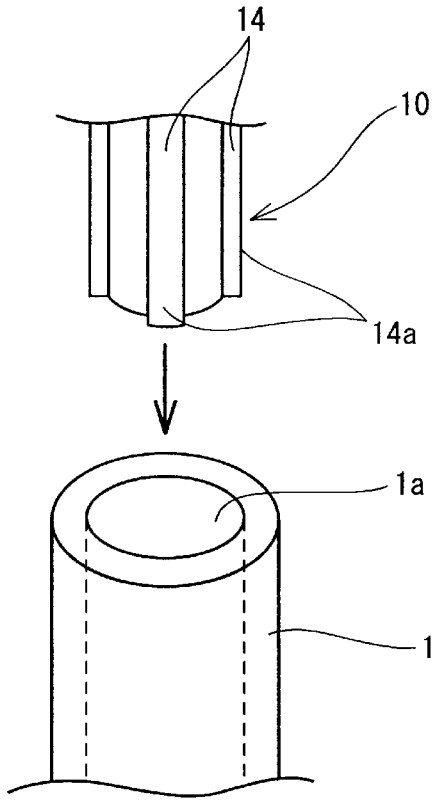
FIGS. 3A and 3B show an insertion method of the vibration absorption member.
Figure 3B:
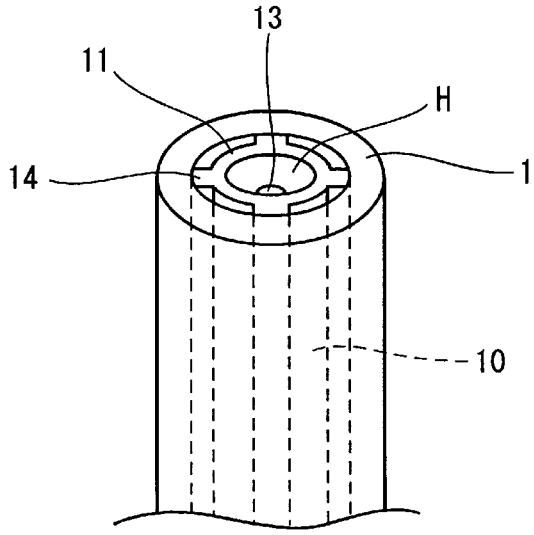

FIGS. 1 through 3 show a golf club shaft (hereinafter referred to as merely shaft) according to a first embodiment of the present invention. A shaft 1 is composed of a laminate of prepregs layered one upon another. A head 2 is installed on the shaft 1 at one end thereof having a smaller diameter. A grip 3 is installed on the shaft 1 at the other end thereof having a larger diameter. The whole length L of the shaft 1 is set to 46 inches. The entire weight of the shaft 1 is set to 50 g before a paint material is applied to the golf club shaft and parts are mounted thereon. The shaft 1 is tapered. A vibration absorption member 10 is fixed to the inside of the hollow and pipe-shaped shaft 1 in the range of 30% of the entire length thereof from the end thereof at the grip (butt) side toward the other end at the head side.

The vibration absorption member 10 has a cylindrical body 11 having a hollow portion H, a columnar central part 13 connected to the body 11 through two connection parts 12 and disposed inside the hollow portion H, four projected parts 14 formed on the peripheral surface of the body 11 in such a way that the four projected parts 14 contact the inner peripheral surface of the pipe-shaped golf club shaft made of a fiber reinforced resin.

More specifically, the central part 13 is fixed at the center thereof in its axial direction with the two connection parts 12 positioned upward and downward from the central part 13 and having a thickness of 1 mm. The central part 13 is disposed at the center of the vibration absorption member 10 in its radial direction.

The four projected parts 14 are disposed at equal intervals in the circumferential direction of the shaft 1 and parallel to the axial direction of the shaft 1. In the axial direction of the shaft 1, the length L of the projected part 14 is equal to that of the body 11. The width w of the projected part 14 is set to 2 mm.

The height h of the projected part 14 is adjusted along the tapered inner side of the shaft 1: A peripheral surface 14*a* of the projected part 14 directly contacts an inner peripheral surface 1*a* of the hollow pipe of the shaft 1. The vibration absorption member 10 is fixed to the inside of the hollow pipe surface of the shaft 1 by applying an adhesive agent to the contact surface of each of the peripheral surface 14*a* of the projected part 14 and that of the inner peripheral surface 1*a* of the hollow pipe of the shaft 1.

The weight of the vibration absorption member 10 is set to 5.0 g. The weight of the central part 13 is set to 20 wt %.of the entire weight of the vibration absorption member 10. The vibration absorption member 10 is made of a dipole conversion material whose loss tangent (tan δ) at 10 is 1.2. The dipole conversion material is composed of chlorinated polyethylene which is a polar high-molecular substance and N,N dicyclohexyl benzothiazole-2-sulphaneamide added to the chlorinated polyethylene. The N,N dicyclohexyl benzothiazole-2-sulphaneamide contains mercaptobenzothiazole radical serving as an active component.

Figure 4:
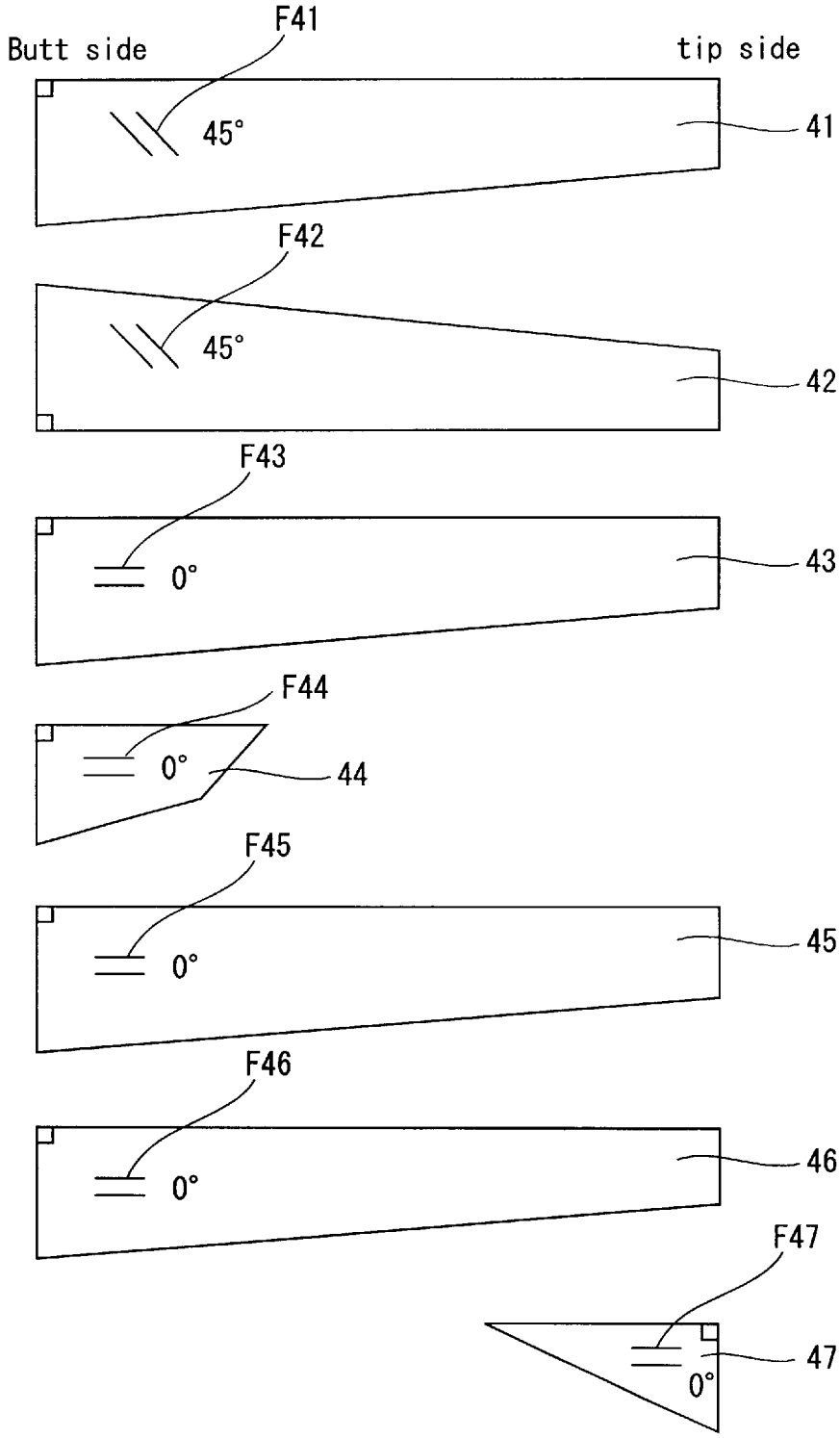
FIG. 4 shows a layering construction of prepregs.

In forming the shaft 1, prepregs 41–47 shown in FIG. 4 are wound on a core metal (not shown) in the order from an inner peripheral side (prepreg 41) thereof to the peripheral side (prepreg 47) thereof. Carbon fibers are used as the reinforcing fibers F41–F47 of the prepregs 41–47. An epoxy resin is used as the matrix resin. The prepreg is used at not less than 50 wt % of the entire weight of the shaft 1 before the paint material is mounted thereon. The carbon fiber used as the reinforcing fiber of the prepreg has a tensile modulus of elasticity not less than 30 tonf/mm$^2$ nor more than 80 tonf/mm$^2$.

The construction of the laminate of the prepregs 41–47 is described below.

In the prepregs 41 and 42, the reinforcing fibers F41 and F42 (tensile modulus of elasticity: 40 tonf/mm$^2$) are bonded to each other by bonding them to each other, with orientation angles thereof with respect to the axis of the shaft 1 set to −45° and +45° respectively.

In the prepreg 43, an orientation angle the reinforcing fiber F43 (tensile modulus of elasticity: 30 tonf/mm$^2$) forms with the axis of the shaft 1 is set to 0°.

In the prepreg 44, an orientation angle the reinforcing fiber F44 (tensile modulus of elasticity: 80 tonf/mm$^2$) forms with the axis of the shaft 1 is set to 0°. The prepreg 44 is disposed at the grip (butt) side to reinforce the grip side.

In the prepregs 45 and 46, an orientation angle each of the reinforcing fiber F45 and F46 (tensile modulus of elasticity: 30 tonf/mm$^2$) forms with the axis of the shaft 1 is set to 0°.

In the prepreg 47, an orientation angle the reinforcing fiber F47 (tensile modulus of elasticity: 30 tonf/mm$^2$) forms with the axis of the shaft 1 is set to 0°. The prepreg 47 is disposed at the head (tip) side to reinforce the head side.

The shaft 1 is formed by sheet winding method as follows: The prepregs 41–47 are layered one upon another by sequentially winding them on the core metal (not shown), a tape made of polyethylene terephthalate is lapped on the laminate. Then integral molding is performed. That is, the tape-lapped laminate is heated in an oven under a pressure to harden the resin. Thereafter the core metal is drawn from the laminate.

As described above, the vibration absorption member 10 made of an elastic material is fixed to the interior of the hollow pipe of the shaft 1 composed of the laminate of the prepregs 41–47. Therefore a player can hit a golf ball a long distance with a golf club composed of the lightweight shaft 1. Further the shaft 1 is capable of suppressing vibrations and impacts to be transmitted to the player. That is, the shaft of the present invention is lightweight and gives a soft feeling to the player.

In particular, since the central part 13 is disposed inside the hollow portion of the body 11 of the vibration absorption member 10 through the connection part 12, the central part 13 is capable of resonating with vibrations of the shaft 1 generated when the player hits the golf ball with the golf club composed of the shaft 1. Thus the shaft 1 provides superior vibration-damping effect.

Figure 5A:
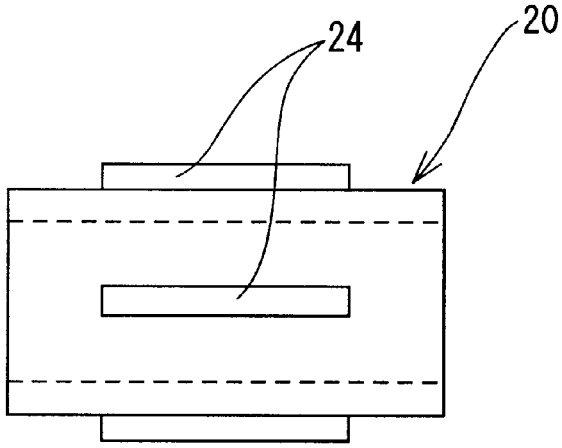
FIGS. 5A and 5B show another mode of a projected part.
Figure 5B:
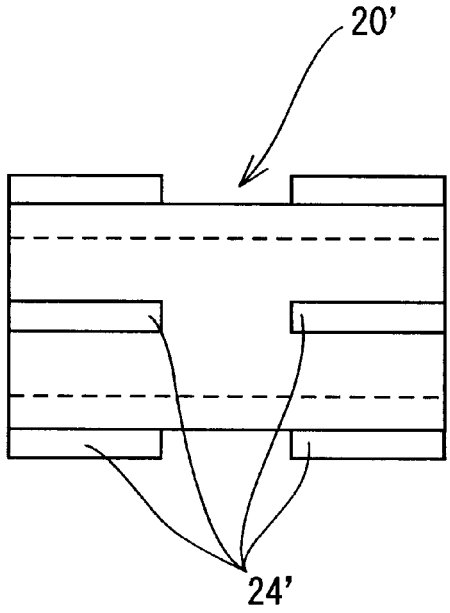
Figure 6A:
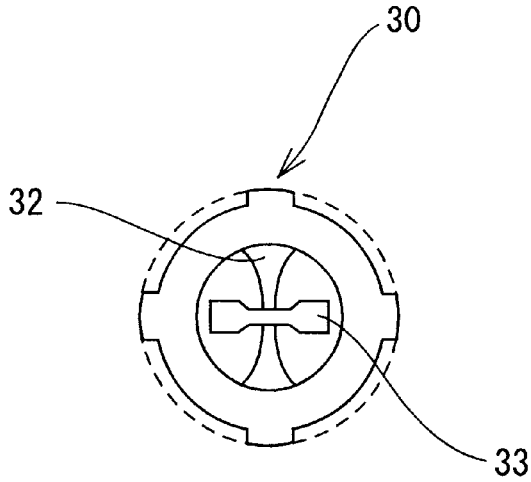
FIGS. 6A and 6B show another mode of the vibration absorption member.
Figure 6B:
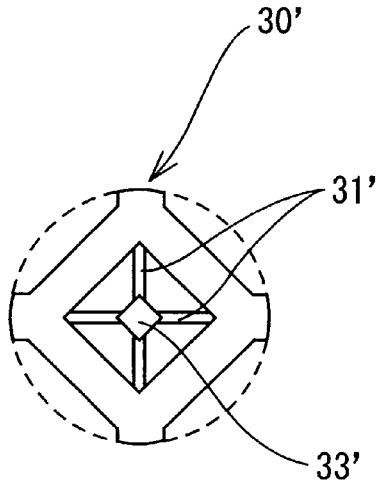

As shown in FIG. 5A, the length of a projected part 24 of a vibration absorption member 20 may be a little shorter than that of the projected part. As shown in FIG. 5B, a projected part 24' of a vibration absorption member 20' may be formed intermittently in the axial direction of the shaft. As shown in FIG. 6A, it is possible to form a vibration absorption member 30 in such a way that the thickness of a connection part 32 thereof changes and a central part 33 is flat. As shown in FIG. 6B, it is possible to form a vibration absorption member 30' in such a way that a body 31' is square cylindrical and a central part 33' is square pillar-shaped. Each of the body, the connection part, the central part, and the projected part of the vibration absorption member may have various configurations and numbers. That is, there is a wide variety of a combination of the body, the connection part, the central part, and the projected part. The position of the vibration absorption member is not limited to a specific position inside the hollow pipe of the shaft.

Measurement of EI (Flexural Rigidity)

Figure 7:
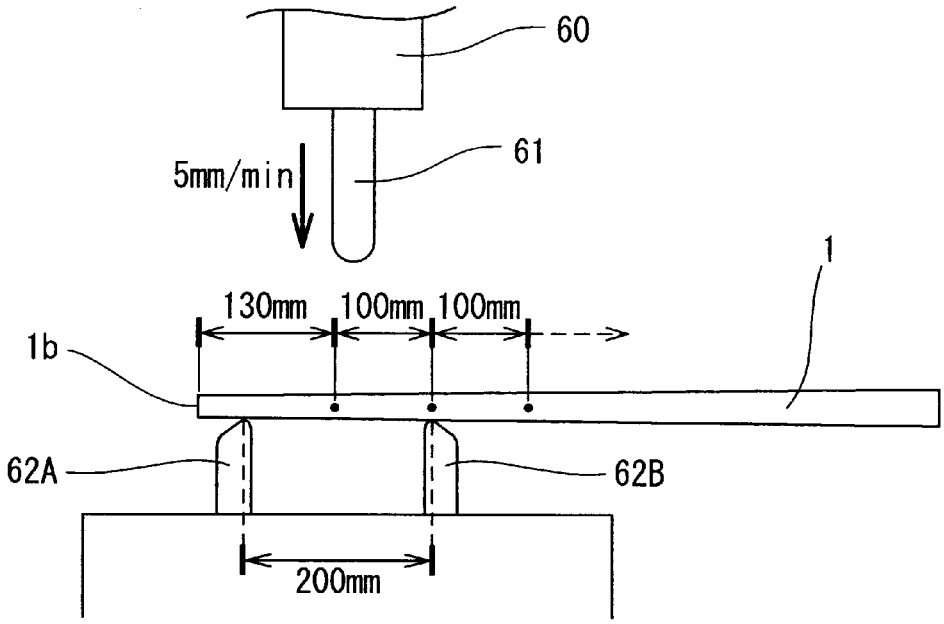
FIG. 7 shows a method of measuring an EI value of the golf club shaft.

As shown in FIG. 7, using a universal testing machine 60, it is preferable to measure the above-described EI value by using three-point bending method and by flexing the shaft 1. The EI value is computed by using the following equation. Measuring points are set every 100 mm from a point distant by 130 mm from an end at the tip (head) of the shaft 1. The shaft 1 is disposed on jigs 62A and 62B in such a way that the measuring points are under an indenter 61 of the universal testing machine 60. The interval between the jigs 62A and 62B is set to 200 mm. The radius of curvature of the indenter 61 at its front end is 75R. The radius of curvature of each of the jigs 62A and 62B at its leading end is 2R. The indenter 61 is moved downward at a speed of 5 mm/min to flex the shaft 1. When a load of 20 kgf is applied to the shaft 1, the movement of the indenter 61 is terminated, and the flexural amount of the shaft 1 at that time is measured.

EI (kg·mm$^2$)=(applied load×(distance between supporting points)$^3$)/(48×flexural amount)

A measured value should be converted into kg·m$^2$.

The golf club shaft of each of examples 1 through 8 of the present invention and that of each of comparison examples 1 through 4 will be described in detail below. Using prepregs having constructions described below, the golf club shaft of each of the examples and the comparison examples was prepared. The condition of the vibration absorption member and the like used in each of the examples and the comparison examples is shown in tables 1 and 2. In each of the examples and the comparison examples, the length of the shaft was set to 46 inches.

TABLE 1

| | CE1 | CE2 | CE3 | E1 | E2 | E3 |
|---|---|---|---|---|---|---|
| Tanδ of vibration absorption member | 0.1 | — | 0.4 | 1.2 | 0.8 | 0.7 |
| Material of vibration absorption member | Ionomer | — | HY:PP = 8:2 | Dipolegee | HY:PP = 8:2 | HY:PP = 7:3 |
| Weight (g) of vibration absorption member | 5.0 | — | 3.0 | 5.0 | 3.0 | 3.0 |
| Ratio of length (from butt) of vibration absorption member to whole length of shaft | 30% | — | 30% | 30% | 30% | 30% |
| Tensile modulus of elasticity (tonf/mm$^2$) of reinforcing fiber of prepreg | 40 | 40 | 40 | 40 | 80 | 46 |
| Wt % | 50 | 50 | 50 | 50 | 50 | 50 |
| Weight (g) of shaft | 50 | 50 | 80 | 50 | 50 | 55 |
| Vibration-damping performance | 0.5 | 0.2 | 1.2 | 1.2 | 1.2 | 1.2 |
| Flight distance (yard) | 250 | 230 | 225 | 250 | 240 | 260 |
| Feeling test | x | x | x | ⊚ | ○ | ⊚ |
| Number of connection parts | 2 | — | 2 | 2 | 2 | 2 |
| wt % of central part | 40 | — | 20 | 20 | 20 | 20 |

where E denotes example of the present invention, and CE denotes comparison example.

TABLE 2

| | E4 | E5 | E6 | E7 | E8 | CE4 |
|---|---|---|---|---|---|---|
| Tanδ of vibration absorption member | 1.2 | 0.7 | 0.7 | 0.7 | 0.7 | 0.1 |
| Material of vibration absorption member | Dipolegee | HY:PP = 7:3 | HY:PP = 7:3 | HY:PP = 7:3 | HY:PP = 7:3 | PP |
| Weight (g) of vibration absorption member | 10.0 | 3.3 | 3.0 | 3.0 | 3.0 | 3.0 |

TABLE 2-continued

| | E4 | E5 | E6 | E7 | E8 | CE4 |
|---|---|---|---|---|---|---|
| Ratio of length (from butt) of vibration absorption member to whole length of shaft | 30% | 30% | 30% | 30% | 30% | 30% |
| Tensile modulus of elasticity (tonf/mm$^2$) of reinforcing fiber of prepreg | 40 | 46 | 46 | 46 | 46 | 46 |
| Wt % | 50 | 50 | 50 | 50 | 50 | 50 |
| Weight (g) of shaft | 50 | 55 | 55 | 55 | 55 | 55 |
| Vibration-damping performance | 1.5 | 0.8 | 1.0 | 0.9 | 1.3 | 0.4 |
| Flight distance (yard) | 250 | 260 | 260 | 260 | 260 | 250 |
| Feeling test | ⊚ | ○ | ⊚ | ○ | ⊚ | x |
| Number of connection parts | 2 | 8 | 4 | 2 | 2 | 2 |
| wt % of central part | 20 | 20 | 20 | 15 | 30 | 20 |

where E denotes example of the present invention, and CE denotes comparison example.

As the dipole gee in the tables 1 and 2, a dipole gee film DP201 (composed of a dipole conversion material. The resin serving as the base of the dipole conversion material was chlorinated polyethylene. The active component was The N,N dicyclohexyl benzothiazole-2-sulphaneamide produced by CCI Inc.) was used as an elastic material. In the tables 1 and 2, HY indicates Hybla (produced by Kuraray Inc.), and PP indicates polypropylene. The HY and the PP were mixed with each other in a pellet state at desired mixing ratios shown in the tables 1 and 2. The mixture was melted at 120° C.–150° C. Thereafter the melted mixture was rod-shaped and pellet-shaped with an extruder.

These materials were injection-molded to prepare a vibration absorption member.

The vibration absorption member was fixed to a required position inside a hollow pipe of each shaft by a method similar to that of the above-described embodiment. That is, an adhesive agent that was a mixture of a chief agent and a hardening agent was used. The adhesive agent was kept at 30° C. to harden it. The vibration absorption member was fixed by bonding the vibration absorption member to the required position inside the hollow pipe of each shaft and by a tapered configuration of the inner side of the shaft.

The layered construction of each of prepregs was similar to that of the above-described embodiment. The tensile moduli of elasticity of the reinforcing fibers of the prepregs of the examples and the comparison examples were different from one another, as shown in the tables 1 and 2.

The tan δ of the vibration-absorbing member was measured with a viscoelasticity measuring apparatus (improved-type viscoelasticity spectrometer "DVA200" manufactured by Shimazu Seisakusho Ltd.). The tan δ was measured under the following conditions: the frequency was 10 Hz; a jig for applying a tensile to the vibration-absorbing member was used; the temperature increase rate was 2° C./min; the initial strain was 2 mm; and the displacement amplitude was ±12.5 μm. As the dimension of each specimen (dumbbell), the width, the thickness, and the length were 4.0 mm, 1.66 mm, and 30.0 mm, respectively. The length of the displacement portion of the specimen was 20.0 mm. The tables 1 and 2 show measured values at 10° C.

As the carbon fiber, of the prepreg, having the tensile modulus of elasticity of 30 tonf/mm$^2$, MR40 produced by Mitsubishi Rayon Kabushiki Kaisha and T800H, M30 produced by Toray industries, Inc. were used. As the carbon fiber having the tensile modulus of elasticity of 40 tonf/mm$^2$, HRX series (HR40) produced by Mitsubishi Rayon Kabushiki Kaisha and M40J produced by Toray industries, Inc. were used. As the carbon fiber having the tensile modulus of elasticity of 80 tonf/mm$^2$, YS-80 produced by Nippon Graphite Kabushiki Kaisha was used. In each of the examples and the comparison examples, the prepreg containing the carbon fiber, as the reinforcing fiber thereof, whose tensile modulus of elasticity is not less than 30 tonf/mm$^2$ nor more than 80 tonf/mm$^2$ was used at not less than 50 wt % of the whole weight of the shaft before a paint material was applied thereto. In the shaft of each of the examples and the comparison examples, the tensile modulus of elasticity of the reinforcing fiber of two inner angular layer prepregs was set as shown in the tables 1 and 2.

EXAMPLE 1

The layering construction of the shaft was similar to that of the above-described first embodiment, as shown in the table 1.

EXAMPLE 2–4

The shafts were prepared by setting items such as the material of the vibration absorption member, the tensile modulus of elasticity of the reinforcing fiber of the prepreg, and the like, as shown in the tables 1 and 2. The configuration of each vibration absorption member was similar to that of the first embodiment.

EXAMPLE 5

Figure 8A:
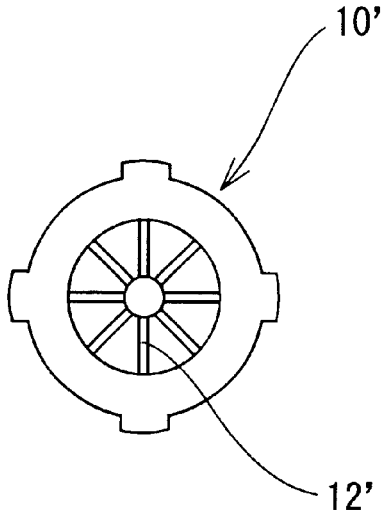
FIGS. 8A and 8B are front views each showing a vibration absorption member of examples 5 and 6.

As shown in FIG. 8A, a vibration absorption member 10' had eight connection parts 12'. The value of each item was set, as shown in the table 2.

EXAMPLE 6

Figure 8B:
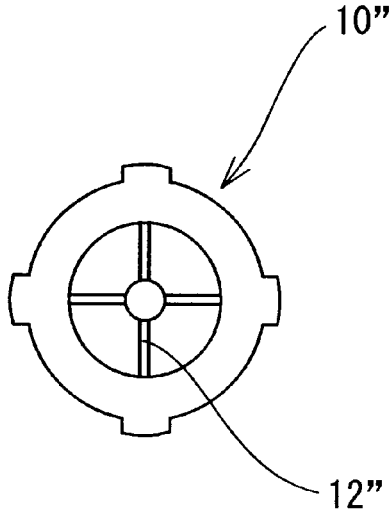

As shown in FIG. 8B, a vibration absorption member 10" had four connection parts 12". The value of each item was set, as shown in the table 2.

EXAMPLE 7 AND 8

The weight of the central part of each vibration absorption member was set as shown in the table 2. The value of each item was also set, as shown in the table 2.

COMPARISON EXAMPLE 1

The vibration absorption member was prepared by using ionomer resin (Hymiran 1652 produced by Mitsui Dupont Polychemical Inc.). The value of each item was set, as shown in the table 1.

COMPARISON EXAMPLE 2

The shaft was not provided with the vibration absorption member. The value of each item was set, as shown in the table 1.

COMPARISON EXAMPLES 3 AND 4

The tan δ of the vibration absorption member was set to 0.4 and 0.1 respectively. The value of each item was set, as shown in the tables 1 and 2. The weight of the shaft of the comparison example 3 was set to 80 g.

The vibration-damping performance and flight distance of each of the shafts of the examples 1–8 and the comparison examples 1–4 was measured by the method described later, and a feeling test was conducted for evaluation. The tables 1 and 2 show results of evaluations.

Method of Measuring Vibration-damping Performance

Figure 9:
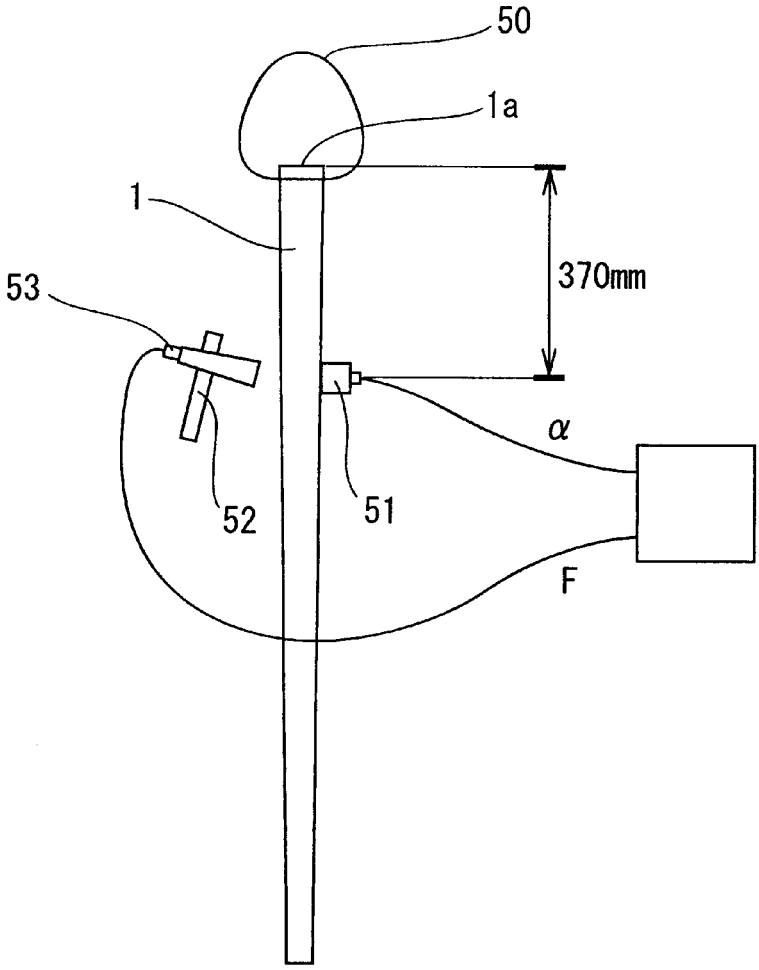
FIG. 9 shows a method of measuring the vibration-damping performance of the golf club shaft.

As shown in FIG. 9, a grip end 1*a* of a shaft 1 was hung with a string 50, and an acceleration pick-up meter 51 was installed on the shaft 1 at a position 370 mm apart from the grip end 1*a*. The side of the shaft 1 opposite to the side on which the acceleration pick-up meter 51 was installed was hit with an impact hammer 52 to vibrate the shaft 1. An input vibration F was measured with a force pink-up meter 53 installed on the impact hammer 52, and a response vibration $\alpha$ was measured with the acceleration pick-up meter 51 to compute the vibration-damping factor (vibration-damping performance) of the shaft 1. The result is shown in table 1.

Measurement of Flight Distance

A head (volume of head: 300 cc) was installed on the shaft of each of the examples and the comparison examples to prepare golf clubs. Ten golfers having handy caps of 5–20 hit three golf balls respectively with the golf clubs. The average value of the three flight distances was shown in the tables 1 and 2.

Feeling Test

The feeling test was conducted by the 10 golfers who hit golf balls in the measurement of the flight distance. The shaft which gave the best feeling to them was marked as ◎. The shaft which gave a good feeling to them was marked as ○. The shaft which did not give a good feeling to them was marked as Δ. The shaft which gave a bad feeling to them was marked as X. An evaluation which obtained most number from the ten golfers was adopted.

As shown in tables 1 and 2, the golf club shaft of each of the examples 1–8 was lightweight. The flight distances of golf balls hit with the golf clubs were in the range of 240 yards to 260 yards. The vibration-damping performance of the golf club shafts was in the range of 0.8 to 1.5. That is, the golf club shafts had high vibration-damping performance. Further they had very favorable results in the feeling test. Thereby it was possible to confirm that the golf club shaft of the present invention was lightweight and hit a golf ball a long distance while it had excellent vibration-damping performance and gave good feeling to the golfers in hitting the golf ball.

On the other hand, in the golf club shaft of the comparison example 1, the tan $\delta$ of the vibration absorption member was as small as 0.1. Therefore the shaft had a low vibration-damping performance and gave a very bad feeling to the golfers. In the golf club shaft of the comparison example 2, since the shaft was not provided with the vibration absorption member. Thus the shaft had lower vibration-damping performance than that the shaft of the comparison example 1. The shaft of the comparison example 3 had good vibration-damping performance, but gave a bad feeling to the golfers. Further since the shaft was as heavy as 80 g, the shaft did not hit the golf ball a long distance. In the golf club shaft of the comparison example 4, the tan $\delta$ of the vibration absorption member was as small as 0.1. Therefore the shaft had low vibration-damping performance and gave a very bad feeling to the golfers.

As apparent from the foregoing description, according to the present invention, the vibration absorption member, made of the elastic material whose tan $\delta$ (loss tangent) is specified, having high vibration-damping performance is installed inside the hollow pipe. Thus the golf club shaft is lightweight and allows a player to hit a golf ball a long distance with a golf club composed of the golf club shaft. The golf club shaft is also capable of reducing vibrations and impacts generated when the golf ball is hit with the golf club and giving a good feeling to the player.

Since the central part is disposed inside the hollow portion of the body of the vibration absorption member through the connection part, the central part is capable of resonating with vibrations of the shaft generated when the golf club hits the golf ball. Thus the shaft provides superior vibration-damping effect.

What is claimed is:

1. A golf club shaft having a hollow pipe shape and composed of a laminate of prepregs, wherein a vibration absorption member made of an elastic material having a tan $\delta$ at 10° C. that is not less than 0.7 is installed on at least one portion inside said hollow pipe-shaped golf club shaft; and said vibration absorption member has a body having a hollow portion, a central part connected to said body through a plurality of connection parts and disposed inside said hollow portion, and a plurality of projected parts formed on a peripheral surface of said body and contacting an inner peripheral surface of said pipe-shaped golf club shaft.

2. The golf club shaft according to claim 1, wherein a weight of said vibration absorption member is not less than 1 g nor more than 10 g; a number of said connection parts is not less than two nor more than 10; and a weight of said central part is not less than 10 wt % nor more than 60 wt % of a whole weight of said vibration absorption member.

3. The golf club shaft according to claim 2, wherein a weight of said golf club shaft is set to not less than 35 g nor more than 70 g before a paint material is applied thereto; and a prepreg which contains a carbon fiber, as a reinforcing fiber thereof, having a tensile modulus of elasticity not less than 30 tonf/mm$^2$ nor more than 80 tonf/mm$^2$ is used for said golf club shaft at not less than 50 wt % of an entire weight of said shaft before said paint material is applied thereto.

4. The golf club shaft according to claim 3, wherein the weight of the golf club shaft is not less than 35 g nor more than 55 g.

5. The golf club shaft according to claim 1, wherein a weight of said golf club shaft is set to not less than 35 g nor more than 70 g before a paint material is applied thereto; and a prepreg which contains a carbon fiber, as a reinforcing fiber thereof, having a tensile modulus of elasticity not less than 30 tonf/mm$^2$ nor more than 80 tonf/mm$^2$ is used for said golf club shaft at not less than 50 wt % of an entire weight of said shaft before said paint material is applied thereto.

6. The golf club shaft according to claim 5, wherein the weight of the golf club shaft is not less than 35 g nor more than 55 g.

7. The golf club shaft according to claim 1, wherein the weight of the vibration absorption member is not less than 3 g nor more than 8 g.

8. The golf club shaft according to claim 1, wherein the weight of the central part is not less than 15 wt % nor more than 30 wt %.

9. The golf club shaft according to claim 1, wherein the vibration absorption member is made of an elastic material having a tan $\delta$ at 10° C. of not less than 1.0 and less than 5.0.

10. The golf club shaft according to claim 1, wherein the vibration absorption member is made of an elastic material having a tan $\delta$ at 10° C. of not less than 1.5 and less than 2.0.

* * * * *